United States Patent [19]

Kohashi et al.

[11] Patent Number: 4,888,132

[45] Date of Patent: Dec. 19, 1989

[54] AQUEOUS RUST INHIBITOR COMPOSITION

[75] Inventors: Hitoshi Kohashi; Nobuhiko Shizuka, both of Hyogo; Yoshihito Kadoma, Osaka, all of Japan

[73] Assignee: Nippon Oil and Fats Co., Ltd., Tokyo, Japan

[21] Appl. No.: 198,350

[22] Filed: May 25, 1988

[30] Foreign Application Priority Data

Jun. 12, 1987 [JP] Japan ..... 65-147628

[51] Int. Cl.[4] ..... C23F 11/12

[52] U.S. Cl. ..... 252/393; 252/396; 252/108; 252/57; 106/14.13; 260/413; 562/478

[58] Field of Search ..... 252/57, 393, 396, 108; 106/14.13; 260/413 R, 413 Q; 562/478

[56] References Cited

U.S. PATENT DOCUMENTS

| | | | |
|---|---|---|---|
| 3,074,983 | 1/1963 | Barrett et al. | 260/413 Q |
| 3,468,920 | 9/1969 | Larimer | 260/407 |
| 3,473,902 | 10/1969 | Eckert | 44/66 |
| 3,573,333 | 3/1971 | Snead et al. | 252/57 |
| 3,773,722 | 11/1973 | Dexter | 260/413 Q |
| 3,893,825 | 7/1975 | Goeller | 44/66 |
| 3,899,535 | 8/1975 | Brown et al. | 260/413 R |
| 4,113,498 | 9/1978 | Rones et al. | 106/14.13 |
| 4,597,906 | 7/1986 | Uhrig et al. | 260/401 |
| 4,661,523 | 4/1987 | Disch et al. | 252/106 |

FOREIGN PATENT DOCUMENTS 1439899 6/1976 United Kingdom .

OTHER PUBLICATIONS

Japanese Patent Abstract, vol. 10, No. 377 (Dec. 16, 1986).

*Primary Examiner*—Paul Lieberman
*Assistant Examiner*—Helene Klemanski
*Attorney, Agent, or Firm*—Sughrue, Mion, Zinn, Macpeak, and Seas

[57] ABSTRACT

An aqueous rust inhibitor containing a soap of a hydroxyaryl fatty acid and an alkali metal. The inhibitor exhibits good rust inhibiting effects without emitting any malodor.

8 Claims, No Drawings

AQUEOUS RUST INHIBITOR COMPOSITION

BACKGROUND OF THE INVENTION

The present invention relates to a novel aqueous rust inhibitor. More particularly, the present invention relates to an aqueous rust inhibitor that forms a stable emulsion for exhibiting satisfactory rust inhibiting effects on metals.

A number of aqueous rust inhibitors have so far been reported. They are divided roughly into two groups: inorganic rust inhibitors based on chromates, nitrites or phosphates, and organic rust inhibitors based on various amines, carboxylates (Japanese Patent Publication No. 59309/1982), or acid amides (Japanese Patent Application (OPI) No. 116791/1985 (the term OPI as used herein means an unexamined published Japanese patent application)).

The use of inorganic rust inhibitors is generally not preferred from the viewpoints of safety and environmental protection. For instance, chromates have strong toxicity, nitrites have the potential to produce nitrosamine, and phosphates cause the problem of eutrophication of rivers and lakes. Organic rust inhibitors also are not ideal since their solubility in water is too low to produce as good rust inhibiting effects as inorganic systems. Among the organic rust inhibitors, amines are relatively effective but they present the problem of producing a malodor. Furthermore, the use of organic rust inhibitors cause problems in association with safety and environmental protection although the problems are not as serious as those presented by inorganic systems.

It has been known that hydroxyaryl fatty acids used as one component of the aqueous rust inhibitor of the present invention have rust inhibiting effects. For instance, hydroxyphenylstearic acid is incorporated in ester oils for refrigerators in order to provide corrosion inhibiting effects (Japanese Patent Application (OPI) No. 171799/1986); hydroxyphenylstearic acid or salts thereof with alkaline earth metals are incorporated in hydrocarbons or diesters in order to provide oxidation stability and rust inhibiting effects (U.S. Pat. No. 3,573,333); salts of hydroxyphenylstearic acid and aliphatic amines are incorporated in gasoline fuels to provide corrosion inhibiting effects (U.S. Pat. No. 3,473,902); and salts of hydroxyphenylstearic acid and N,N-disubstituted amines are incorporated in jet fuel to provide corrosion inhibiting effects (U.S. Pat. No. 3,893,825). All of these prior art techniques aim at providing rust or corrosion inhibiting effects by incorporating hydroxyphenylstearic acid or salts thereof with amines or alkaline earth metals in nonaqueous media. In other words, the objective of the prior art techniques is to inhibit rusting in nonaqueous systems and not in aqueous systems as intended by the present invention.

As a mechanism of rust development on metal surfaces may be mentioned the occurrence of electrochemical reaction between coexistent oxygen and water molecules. Successful rust inhibition requires therefore preventing the adsorption of the oxygen or water molecule on metal surfaces. In nonaqueous systems where the oxygen and water molecules are present in much smaller amounts than in aqueous systems, the chance of rust development is inherently so slow that rusting can satisfactorily be prevented with the aid of organic rust inhibitors containing polar groups. On the other hand, effective rust inhibition is extremely difficult to accomplish in aqueous systems where the oxygen and water molecules are present in very large amounts. In order to achieve rust inhibition by suppressing the occurrence of electrochemical reaction on metal surfaces, either inorganic rust inhibitors that passivate the metal surfaces or organic rust inhibitors that form an adsorption layer on the metal surfaces, are employed. However, because of their structure, organic rust inhibitors are only sparingly soluble in water. In addition, the adsorption layer once formed can be disrupted by the water molecules, which are more polar. For these reasons, organic rust inhibitors are essentially less effective than inorganic systems.

In order to compensate for these defects, main organic rust inhibitors to be used in aqueous system generally are based on compounds that have low molecular weights ($\leqq 300$) and large of polarity, and attempts have been made to dissolve these compounds completely in water and to form a stronger adsorption layer on metal surfaces. It has therefore been the general understanding that in the light of their structure, fatty acid soaps having at least 18 carbon atoms are too high in their oiliness to be suitable for use as rust inhibitors in aqueous systems. It has been clear in the prior art that alkaline earth metals such as calcium and amines are effective as soap-forming bases, but it has been entirely unexpected that soaps using alkali metals such as sodium and potassium will also exhibit excellent rust inhibiting effects.

It has been proposed that various compounds made from arylated fatty acids are used in aqueous systems (U.S. Pat. No. 4,597,906). However, these techniques relate to methods of using such compounds as surface active agents, particularly as dispersing agents, wetting agents, emulsifiers or as dyeing auxiliaries and hence differ completely from the present invention whose objective is rust inhibition.

The present inventors previously found that salts of hydroxyaryl fatty acids and amines containing 2-6 carbon atoms would exhibit satisfactory rust inhibiting effects and filed a patent application on an invention based on this finding (Japanese Patent Application No. 281995/1986). However, there still remain problems to be solved since the use of amines causes problems in association with safety and environmental protection although the problems are not so serious as those presented by inorganic rust inhibitors.

In order to be successful, a rust inhibitor must satisfy many requirements but among other things, effectiveness in rust inhibition is most important. However, existing products that have the problems mentioned above are not completely satisfactory for use as industrial rust inhibitors under increasingly diverse and hostile conditions. It has therefore been strongly needed to develop rust inhibitors that exhibit even better performance.

SUMMARY OF THE INVENTION

An object of the present invention is to provide an organic rust inhibitor that will cause no problem in association with safety or environmental protection and which yet exhibits good rust inhibiting effects without emitting any malodor.

In order to attain this object, the present inventors have conducted intensive studies and found that by using a specified fatty acid soap as an organic rust inhibitor, an improved aqueous rust inhibitor can be obtained that is free from the problems presented by conventional inorganic rust inhibitors in association with satefy and environmental protection and which yet exhibits significant rust inhibiting effects without emitting any malodor. The present invention has been accomplished on the basis of this finding.

According to the present invention there is provided to an aqueous rust inhibitor containing a soap of a hydroxyaryl fatty acid and an alkali metal.

DETAILED DESCRIPTION OF THE INVENTION

The hydroxyaryl fatty acid used in the present invention is an aryl fatty acid containing a phenolic hydroxyl group in the molecule. Among such aryl fatty acids, the object of the present invention can be attained most advantageously by hydroxylaryl fatty acids having the following general formula:

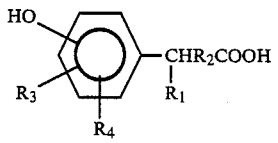

where $R_1$ is a straight chain alkyl group having 1–19 carbon atoms; $R_2$ is a straight chain alkylene group having 1–19 carbon atoms, with the sum of carbon atoms in $R_1$ and $R_2$ being in the range of 10–20; $R_3$ and $R_4$ are each a hydrogen atom, a hydroxyl group, an alkyl group having 1–9 carbon atoms, or an alkoxyl group having 1–9 carbon atoms.

Specific examples of the hydroxyaryl fatty acids suitable for use in the present invention include: hydroxyphenylmyristic acid, hydroxyphenylpalmitic acid, hydroxyphenylstearic acid, hydroxyphenyloleic acid, hydroxyphenylbehenic acid, dihydroxyphenylmyristic acid, dihydroxyphenylpalmitic acid, dihydroxyphenylstearic acid, dihydroxyphenylbehenic acid, trihydroxyphenylpalmitic acid, trihydroxyphenylstearic acid, hydroxymethylphenylstearic acid, hydroxynonylphenylpalmitic acid, hydroxydimethylphenylstearic acid, hydroxymethoxyphenylstearic acid, and hydroxymethoxyphenylbehenic acid.

Examples of the alkali metal suitable for use in the present invention include lithium, sodium and potassium. Sodium and potassium are particularly preferred since soaps that use them produce a very stable emulsion while exhibiting high rust inhibiting effects. In the present invention, such alkali metals are used instead of odorous components such as amines, so it becomes possible to obtain odorless rust inhibitors.

A soap made of a hydroxylaryl fatty acid and an alkali metal can be prepared by performing a reaction similar to the ordinary neutralization reaction. The reaction molar ratio of the hydroxylaryl fatty acid to the alkali metal is not limited to any particular value. The hydroxyaryl fatty acid that remains unreacted has rust inhibiting effects and will not cause any adverse effects on the performance of the resulting soap. However, in order to ensure emulsion stability, the alkali metal is preferably used in an amount of at least 0.7 equivalents with respect to the carboxyl group.

The soap of the present invention may be used alone as a rust inhibitor. It may also be used in combination with known conventional rust inhibitors. In whichever method of use, the soap of the present invention is preferably employed in an amount of 0.05–5 wt % of an aqueous solution. If the content of the soap is less than 0.05 wt %, excellent rust inhibiting effects will not result. Even if the content of the soap exceeds 5 wt %, no further increase in the rust inhibiting effects will be achieved. Using more than 5 wt % soap is not therefore economical.

By using a long-chain fatty acid represented by the above-noted general formula as the hydroxyaryl fatty acid a soap having not only rust inhibiting effects but also lubricity is obtained in accordance with the present invention. This soap is therefore capable of fullly exhibiting its features when incorporated in aqueous lubricating oils. In other words, the rust inhibitor of the present invention containing this soap is suitable for use in aqueous lubricants for metal working such as cutting fluids, grinding fluids, rolling oils and drawing oils. The above-described soap, which is a kind of long-chain fatty acid soaps, also possesses cleaning action, and it is thus effective not only for inhibiting rusting in systems that perform cooling with aqueous media such as cooling towers and radiators but also as antifouling agent for metal parts.

By using the soap of the present invention a rust inhibitor can be obtained that is not only capable of preventing rusting of metals but which is odorless and does not present any problems in association with safety or environmental protection. Therefore an aqueous rust inhibitor containing the soap of the present invention finds utility in a broad scope of metal-related applications and is particularly suitable for use in aqueous lubricants for metal working and in cooling systems that employ aqueous media.

The following example is provided for the purpose of further illustrating the present invention but is in no way to be taken as limiting. Five hydroxyaryl fatty acids (a)–(e) used in the example were prepared by the following procedures.

Preparation of hydroxyphenylstearic acid (a)

A 500-ml autoclave was charged with 166 g of commercial oleic acid (product of Nippon Oils & Fats Co., Ltd.), 169 g of phenol (product of Katayama Kagaku Kogyo K.K.), 6.6 g of activated clay (Nippon Kassei Hakudo K.K.), and 0.13 g of 85% aqueous phosphoric acid (product of Katayama Kagaku Kogyo K.K.). After purging the autoclave with nitrogen gas, the contents were allowed to react by heating at 200° C. for 4 hours. After completion of the reaction, the activated clay was filtered off and the unreacted phenol was distilled away at 80°–100° C., 3 mmHg to yield a yellow viscous reaction product in an amount of 224 g.

The other hydroxyaryl fatty acids (b)–(e) used in the example were also synthesized in accordance with the procedures described above. The acid and hydroxyl values of the reaction products are shown in Table 1 below.

TABLE 1

| Symbol | Hydroxyaryl fatty acid | Starting materials: Fatty acid | Starting materials: Aryl compound | Analytical value: Acid value | Analytical value: OH vaule |
|---|---|---|---|---|---|
| a | Hydroxyphenylstearic acid | Commercial Oleic acid[1] | Phenol | 145.3 | 121.6 |
| b | Hydroxymethylphenylstearic acid | Commercial Oleic acid[1] | p-Cresol | 130.2 | 123.0 |
| c | Dihydroxyphenylstearic acid | Commercial oleic acid[1] | Catechol | 131.7 | 220.1 |
| d | Hydroxynonylphenylstearic acid | Commercial oleic acid[1] | Nonyl phenol | 106.6 | 88.4 |
| e | Hydroxyphenylbehenic acid | Commercial Erucic acid[2] | Phenol | 124.6 | 115.2 |

Notes:
[1]$C_{14}F_1$ acid, 4%; $C_{16}F_1$ acid, 6%; $C_{18}F_1$ acid, 67%; $C_{18}F_2$ acid, 8%
[2]$C_{22}F_1$ acid, 88% ($F_1$ is a monoalkenoic acid, and $F_2$ is a dialkenoic acid)

EXAMPLE

Hydroxyaryl fatty acids (a)–(e) combined with alkali metals indicated in Table 2 were subjected to neutralization reaction performed by using the procedures described below to form 20 wt % aqueous soap solutions identified by sample Nos. 1–17. These aqueous soap solutions were directly used as aqueous rust inhibitors according to the present invention. Neutralization reaction:

A four-necked flask (1,000 ml) was charged with predetermined amounts of a hydroxylaryl fatty acid and water and the contents were heated to 50° C. An aqueous solution (20 wt %) of an alkali hydroxide was added dropwise with stirring in a stoichiometric amount with respect to the acid value of the hydroxylaryl fatty acid. By agitation for an additional 30 minutes, a 20 wt % aqueous solution of alkali metal soap of the hydroxyarylfatty acid was produced.

The emulsion characteristics and the rust inhibiting effects of aqueous rust inhibitors Nos. 1–17 were examined by using the procedures described below. The results are summarized in Table 2 together with the results obtained for comparative sample Nos. 18–22 that employed known rust inhibitors and for a blank sample No. 23 that did not employ any rust inhibitor.

Testing Emulsion Characteristics

This test was conducted in accordance with the testing method for the emulsion characteristics of lubricating oils described in JIS K 2520. A sample container was charged with a predetermined amount of an aqueous rust inhibitor and filled up with water to make a total volume of 80 ml. The container was placed in a constant-temperature bath at 54°±1° C. and the sample was emulsified by stirring with an agitator at 1,500±15 R.P.M. for 5 minutes. The emulsion was left to stand in an air conditioned room at 20° C. One week later, the state of the emulsion was evaluated by the following criteria:

excellent: translucent and stable emulsion
good: opaque and stable emulsion
poor: partial separation occurred
clear: clear and uniform aqueous solution

Testing Rust Inhibiting Effect

A cold-rolled steel plate SPCC-B (JIS G 3141) was used as a test piece. A sample to be tested was dissolved in water to give a predetermined concentration and the test piece was entirely dipped in the aqueous solution. Thereafter, the upper half of the test piece was raised above the surface of the solution so that it was exposed to air. The development of rust on the test piece was observed at 20° C. as a function of time. Rust developed initially at the interface between the solution and air; it spread with time to the area exposed to air and then to the area dipped in the solution. The rust inhibiting effect of the sample under test was evaluated by the following criteria in terms of the percentage of the rusted area with the total area of the test piece taken as 100%:

A: no visible rust developed
B: rusted area of less than 10%
C: rusted area of from 10% to less than 30%
D: rusted area of from 30% to less than 50%
E: rusted area of at least 50%

TABLE 2

| Sample No. of Invention | Starting materials: Hydroxyaryl fatty acid[1] | Starting materials: Alkali metal | Molar ratio[2] | Concentration of aqueous solution (wt %) | Emulsion stability | Rust inhibiting effect: 4 days | Rust inhibiting effect: 21 days | Rust inhibiting effect: 45 days |
|---|---|---|---|---|---|---|---|---|
| 1 | a | Na | 0.6 | 0.3 | good | A | A | C |
| 2 | a | Na | 0.8 | 0.3 | excellent | A | A | B |
| 3 | a | Na | 0.8 | 1.0 | excellent | A | A | B |
| 4 | a | Na | 1.0 | 0.03 | excellent | A | B | D |
| 5 | a | Na | 1.0 | 0.1 | excellent | A | A | C |
| 6 | a | Na | 1.0 | 3.0 | excellent | A | A | B |
| 7 | a | Na | 1.0 | 7.0 | excellent | A | A | B |
| 8 | a | Na | 1.2 | 0.3 | excellent | A | A | B |
| 9 | a | Na | 1.5 | 0.3 | excellent | A | A | B |
| 10 | b | Na | 1.0 | 0.3 | excellent | A | A | B |
| 11 | c | Na | 1.0 | 0.3 | excellent | A | A | B |

TABLE 2-continued

| | | | | | | | | |
|---|---|---|---|---|---|---|---|---|
| 12 | d | Na | 1.0 | 0.3 | excellent | A | A | B |
| 13 | e | Na | 1.0 | 0.3 | excellent | A | A | B |
| 14 | a | K | 0.8 | 0.3 | excellent | A | A | B |
| 15 | a | K | 1.2 | 0.3 | excellent | A | A | B |
| 16 | a | Li | 0.8 | 0.3 | good | A | A | B |
| 17 | a | Li | 1.2 | 0.3 | excellent | A | A | B |

| Sample No. of Comparison | Starting materials | Molar ratio[2] | Concentration of aqueous solution (wt %) | Emulsion stability | Rust inhibiting effect 4 days | 21 days | 45 days |
|---|---|---|---|---|---|---|---|
| 18 | Sodium oleate | 1.0 | 0.3 | excellent | B | E | E |
| 19 | Potassium oleate | 1.0 | 0.3 | excellent | B | E | E |
| 20 | Sodium benzoate | 1.0 | 0.3 | clear | B | D | E |
| 21 | Commercial rust inhibitor[3] | — | 0.3 | clear | A | A | B |
| 22 | Commercial rust inhibitor[4] | — | 0.3 | excellent | A | B | C |
| 23 | Blank | — | — | — | B | E | E |

Notes:
[1]Hydroxyaryl fatty acids a–e are those shown in Table 1.
[2]the number of moles of the alkali metal with respect to one mole of the hydroxyaryl fatty acid
[3]nitrite based
[4]carboxylic acid amine based As is clear from Table 2, the soaps prepared from hydroxyaryl fatty acids and alkali metals according to the present invention form stable emulsions and can be used as effective organic rust inhibitors.

While the invention has been described in detail and with reference to specific embodiments thereof, it will be apparent to one skilled in the art that various changes and modifications can be made therein without departing from the spirit and scope thereof.

What is claimed is:

1. An aqueous rust inhibitor containing a soap of (i) a hydroxyaryl fatty acid and (ii) an alkali metal, wherein the soap is present in an amount of 0.05–5 wt % based on the total amount of the aqueous rust inhibitor; and wherein the soap is represented by the following formula (I):

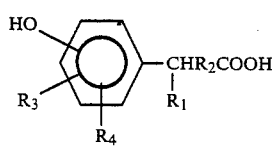

(I)

wherein $R_1$ is a straight chain alkyl group having 1 to 19 carbon atoms; $R_2$ is a straight chain alkylene group having 1 to 19 carbon atoms, with the sum of carbon atoms in $R_1$ and $R_2$ being 10 to 20; $R_3$ and $R_4$ are each a hydrogen atom, a hydroxyl group, an alkyl group having 1 to 9 carbon atoms, or an alkoxyl group having 1 to 9 carbon atoms; and M is an alkali metal cation.

2. An aqueous rust inhibitor according to claim 1, wherein the hydroxyaryl fatty acid is hydroxyphenylstearic acid.

3. An aqueous rust inhibitor according to claim 1, wherein the hydroxyaryl fatty acid is hydroxyphenylbehenic acid.

4. An aqueous rust inhibitor according to any one of claims 1 to 3, wherein the alkali metal is potassium or sodium.

5. An aqueous rust inhibitor according to claim 1, wherein the molar ratio of the alkali metal to the hydroxyaryl fatty acid is at least 0.7.

6. An aqueous rust inhibitor according to claim 5, wherein the hydroxyaryl fatty acid is hydroxyphenylstearic acid.

7. An aqueous rust inhibitor according to claim 5, wherein the hydroxyaryl fatty acid is hydroxyphenylbehenic acid.

8. An aqueous rust inhibitor according to any one of claims 5 to 7 wherein said alkali metal is potassium or sodium.

* * * * *